US007553200B2

(12) United States Patent
Plummer

(10) Patent No.: US 7,553,200 B2
(45) Date of Patent: Jun. 30, 2009

(54) BATTERY TERMINAL FOR A VEHICLE

(75) Inventor: Lew Plummer, Mount Vernon, WA (US)

(73) Assignee: PACCAR Inc, Bellevue, WA (US)

( * ) Notice: Subject to any disclaimer, the term of this patent is extended or adjusted under 35 U.S.C. 154(b) by 0 days.

(21) Appl. No.: 11/694,718

(22) Filed: Mar. 30, 2007

(65) Prior Publication Data

US 2008/0242159 A1 Oct. 2, 2008

(51) Int. Cl.
*H01R 4/38* (2006.01)

(52) U.S. Cl. ..... 439/766; 439/883

(58) Field of Classification Search ..... 439/766, 439/883, 801

See application file for complete search history.

(56) References Cited

U.S. PATENT DOCUMENTS 5,529,509 A * 6/1996 Hayes et al. ..... 439/288
5,655,936 A * 8/1997 Meredith ..... 439/801
7,125,295 B2 * 10/2006 Zhao et al. ..... 439/883

* cited by examiner

*Primary Examiner*—Javaid Nasri
(74) *Attorney, Agent, or Firm*—Christensen O'Connor Johnson Kindness PLLC

(57) ABSTRACT

A battery cable terminal fitting is provided for a battery having a terminal post. The battery cable terminal fitting comprises an attachment flange and a conductor attachment portion extending from the attachment flange. The attachment flange has an interface area extending between the attachment flange and the terminal post when the battery cable terminal fitting is coupled to the battery. The interface area has a battery contact area that increases as a nut used to fasten the attachment flange to the terminal post is tighten.

14 Claims, 5 Drawing Sheets

BATTERY TERMINAL FOR A VEHICLE

BACKGROUND

Typical battery terminal connections used in most commercial trucks are known as "stud and post" connections. One such connection may be best understood by referring to FIG. 1. This terminal configuration includes a threaded stud 10 protruding through the center of a lead battery post 12. Current stored in the battery 14 passes out of and into the battery through positive and negative lead posts. Typically, a copper ring terminal 16 with a conductor attached is used to carry electrical loads from and return to the battery. The threaded stud 10 retains the ring terminal concentric to the battery post 12 when making the electro/mechanical connection.

A nut 18 is threaded on the stud 10 and provides compressive force required to clamp the ring terminal 16 to the battery post 12. The compressive force concentrates the clamping force on a small area around the battery post 12, thereby pressing the soft copper ring terminal 16 into the very soft lead battery post 12. Due to the center concentrated clamping force, the outer perimeter A of the ring terminal 16 bends upwardly or lifts off the battery terminal, resulting in a ring terminal 16 that is concave in cross-section as seen in FIG. 1. This is undesirable as the concave shape of the ring terminal 16 reduces the required contact area between the ring terminal 16 and the battery post 12 by approximately 55%. The center concentrated clamping force also extrudes a small amount of the soft lead battery post 12, causing the ring terminal 16 to loosen and, thereby, reduces the frictional forces required for retention under the retaining nut 18.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with aspects of the present disclosure, a battery cable terminal fitting is provided for a battery having a terminal post. The battery cable terminal fitting comprises an attachment flange and a conductor attachment portion extending from the attachment flange. The attachment flange has an interface area extending between the attachment flange and the terminal post when the battery cable terminal fitting is coupled to the battery. The interface area has a battery contact area that increases as a nut used to fasten the attachment flange to the terminal post is tighten.

DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION

Figure 1:
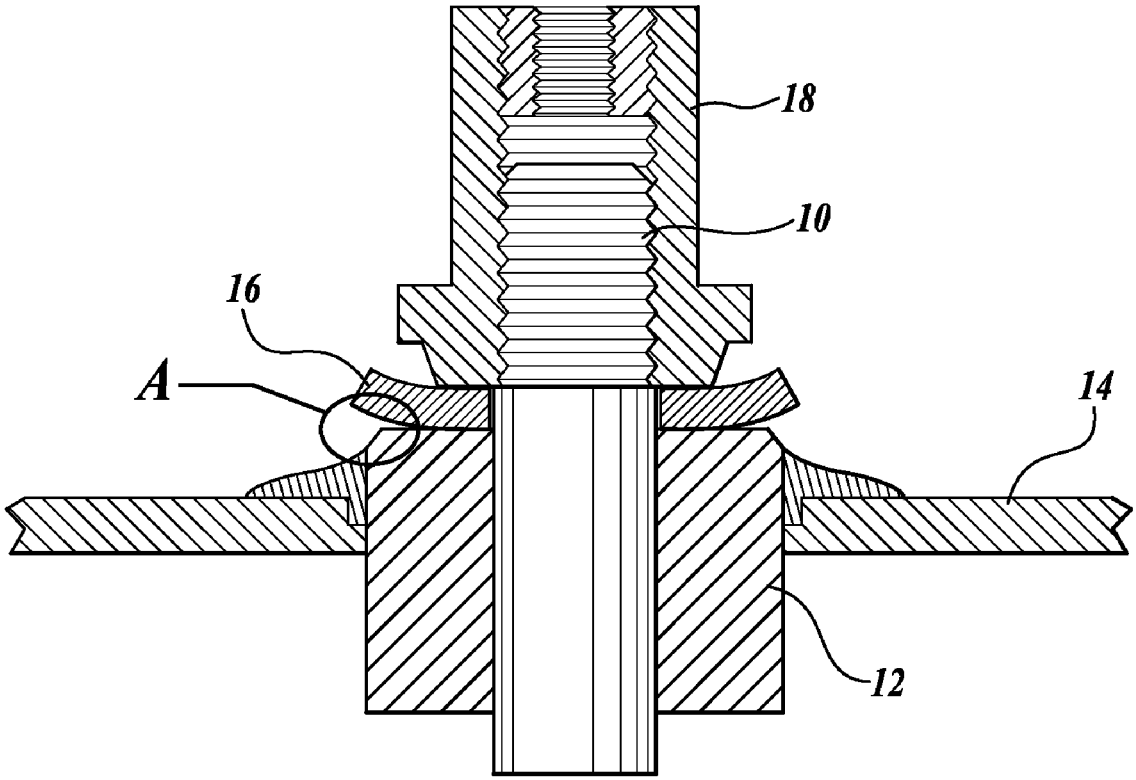
Fig.1. (PRIOR ART)
FIG. 1 is a cross-sectional side view of a prior art connection between a battery and a battery cable assembly, showing typical "lift" of peripheral regions of a battery cable terminal fitting associated with a center concentrated clamping force.
Figure 2:
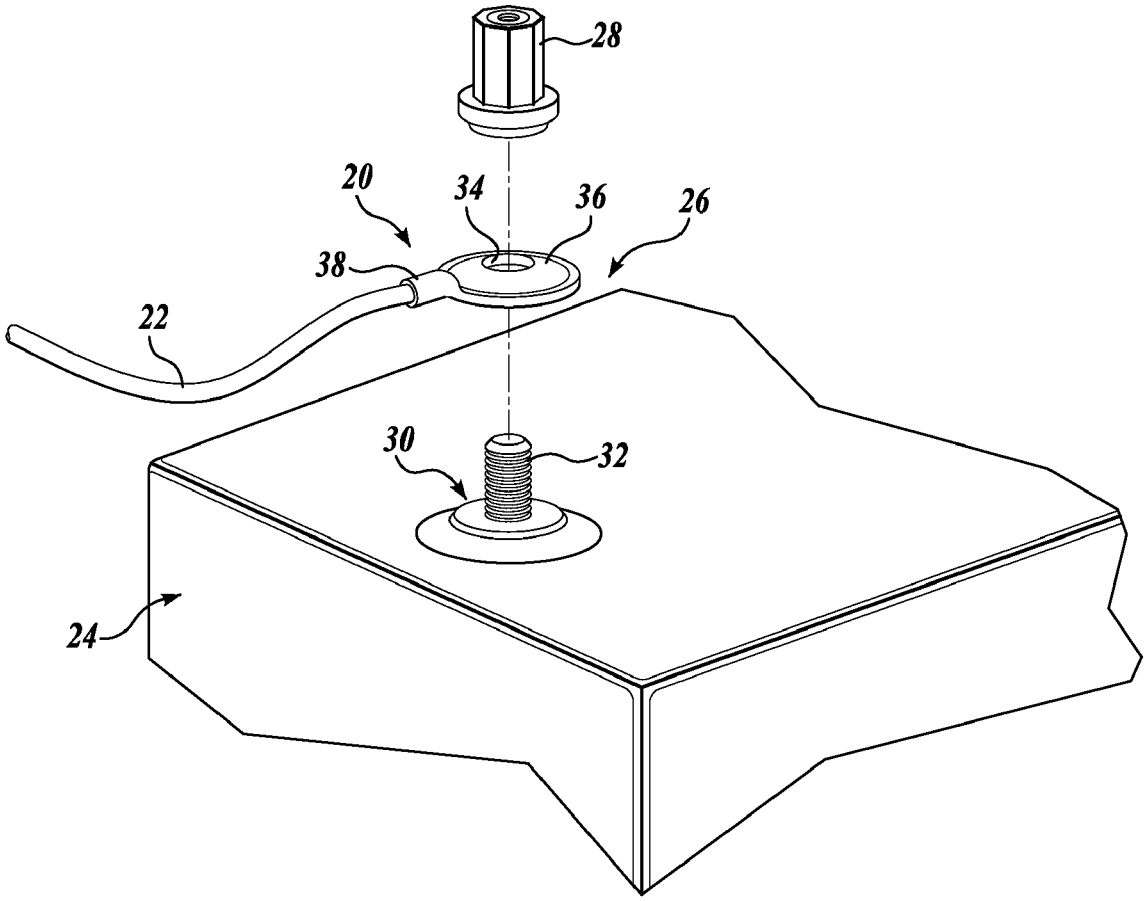
FIG. 2 is a partial isometric view of a battery cable terminal fitting constructed in accordance with one embodiment of the present disclosure, showing an exploded view of a connection between a battery and the battery cable terminal fitting with a substantially conical attachment flange.
Figure 3:
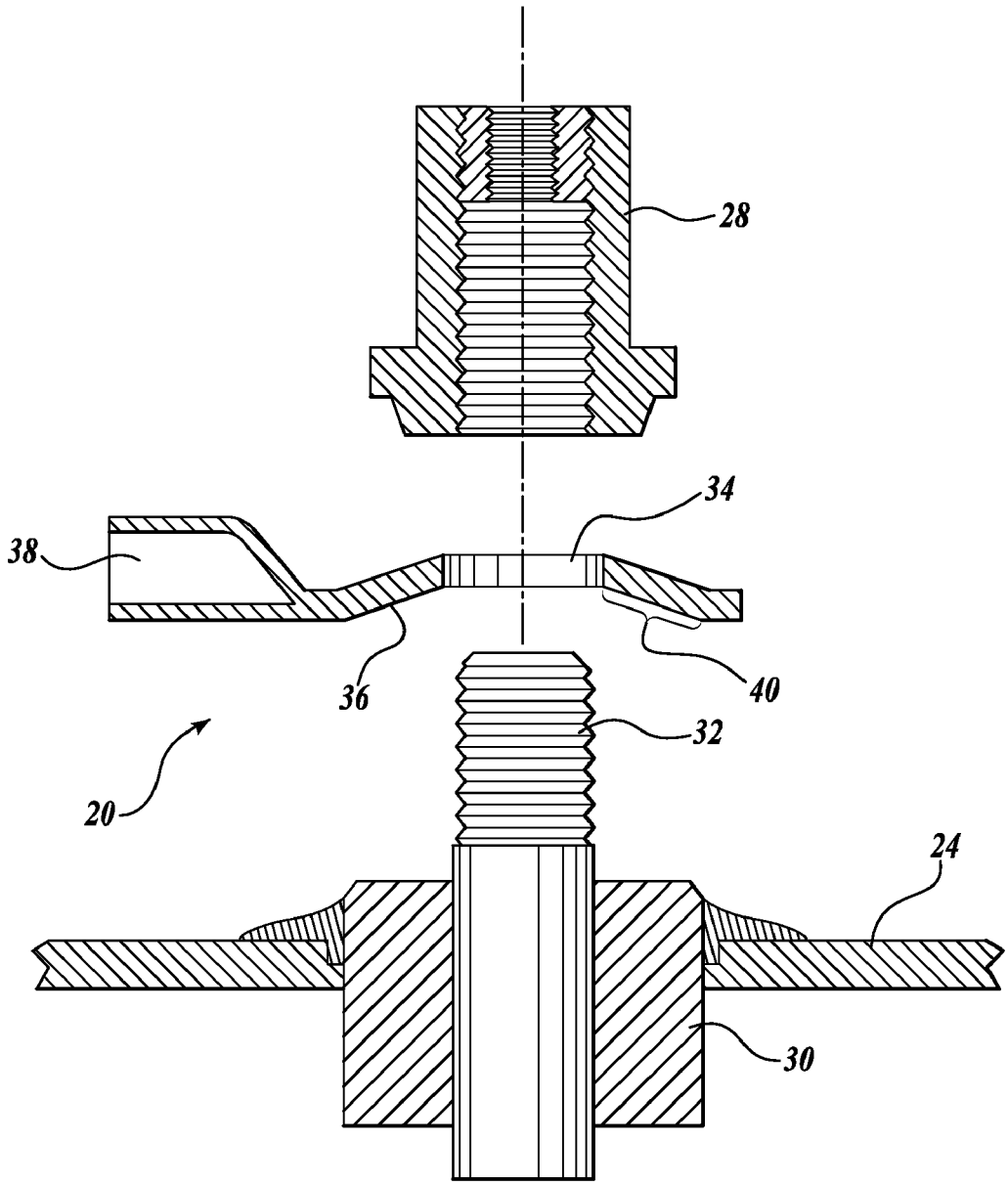
FIG. 3 is an exploded cross-sectional view of the battery cable terminal fitting of FIG. 2.

A battery cable terminal fitting ("fitting 20") constructed in accordance with one embodiment of the present disclosure may be best understood by referring to FIGS. 2 and 3. The fitting 20 is configured and adapted to electrically and mechanically connect a battery cable 22 to a battery 24. The battery 24 includes battery cable connection assembly 26.

The battery cable connection assembly 26 includes a nut 28 and a terminal post 30 having a threaded stud 32. The battery cable connection assembly 26 is well-known and is configured to couple the cable 22 to the battery 24 by the fitting 20.

The fitting 20 includes an attachment flange 36 having a centrally located aperture 34 sized and configured to slidably fit over the threaded stud 32. The fitting 20 is releasably coupled to the threaded stud 32 by the nut 28. The fitting 20 also includes a cable attachment portion 38 adapted to electrically connect the fitting to the cable 22, as is well known in the art. The attachment flange 36 and cable attachment portion 38 are suitably integrally formed from a well-known material, such as copper.

Figure 4:
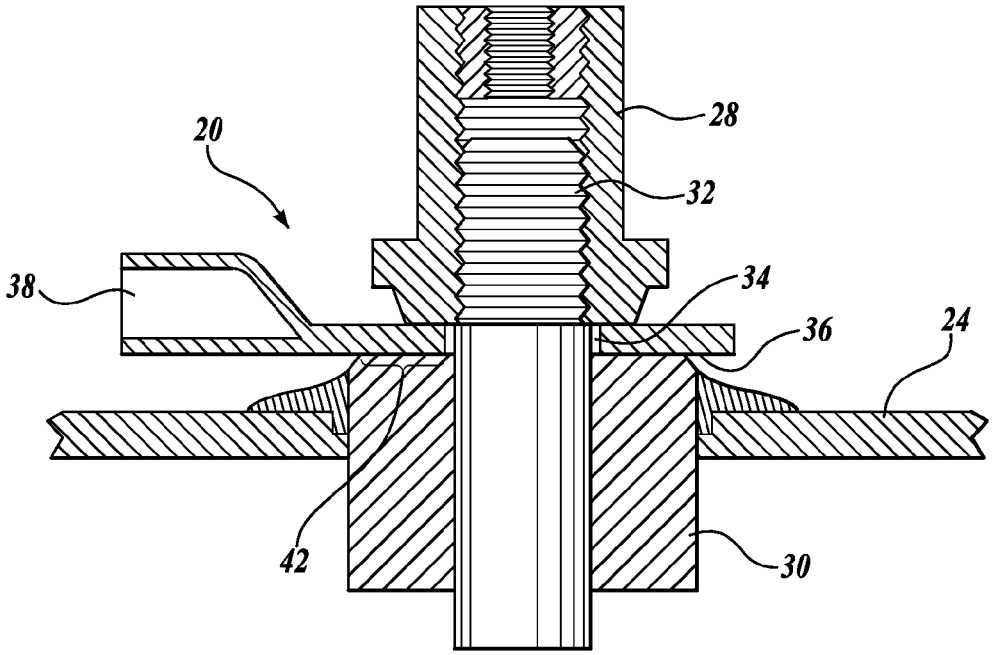
FIG. 4 is a cross-sectional side view of the battery cable terminal fitting of FIG. 2, showing the battery cable terminal fitting removably coupled to a terminal post of a battery.

As may be best seen by referring to FIGS. 3 and 4, the lower surface of the attachment flange 36 includes an interface area 40. This area 40 extends between the attachment flange 36 and the terminal post 30 when the fitting 20 is coupled to the battery 24. The interface area 40 has a battery contact area 42 that increases as the nut 28 used to fasten the fitting 20 to the terminal post 30 is tightened. More specifically, as the interface area 40 is compressed against the upper surface of the terminal post 30, the contoured portion of the interface area 40 collapses against the terminal post 30. The portion of the interface area 40 that interfaces with the terminal post 30 defines the battery contact area 42.

The attachment flange 36 of the fitting 20 is configured to enhance electrical and mechanical attachment of the cable 22 to the battery 24. The attachment flange 36 is substantially conical in contour. The contour in the attachment flange 36 is geometrically shaped to generate increased peripheral interface force between the attachment flange 36 and the terminal post 30 when the nut 28 is installed with the appropriate amount of installation torque. Although the attachment flange 36 is illustrated and described as substantially conical in contour, it should be apparent that other shapes, such as ovoid, round, square, triangular, etc., are also within the scope of the appended claims.

Operation of the fitting 20 may be best understood by referring to FIGS. 2-4. The fitting 20 is placed over the threaded stud 32 of either the positive or negative terminal post 30 of the battery 24. The fitting 20 is attached to the terminal post 30 by inserting the aperture 34 over and onto the threaded stud 32. The nut 28 is then threaded onto the threaded post 32 to secure the fitting 20 to the terminal post 30. Thereafter, a torque is applied to the nut 28 to secure the fitting 20 to the threaded post 32. As the torque is applied to the nut 28, the outer parameter of the attachment flange is pressed against the outer area of the lead post. The final torque applied to the nut will fully flatten the attachment flange 36 against the lead battery post, as best shown in FIG. 4. This increases the flange/lead post contact area by approximately 40% thereby reducing current loss at the connection. Furthermore, preloading the nut with the conical terminal helps maintain contact when subjected to vibration. To remove the fitting 20, the preceding steps are reversed.

It has been discovered by the present inventor that forming the attachment flange 36 such that it is substantially conical in contour retains the electro/mechanical connection by increasing the frictional contact area at the connection between the fitting 20 and the terminal post 30. As a non-limiting example, the substantially conical shape of the attachment flange 36 increases the contact area by approximately 40% when compared to prior art fittings. Increasing the contact area increases the electrical efficiency leading to improved current function, such as engine start.

In several embodiments that utilize copper or other materials with similar mechanical properties, the fitting 20 can be reused since the amount of contour formed in the attachment flange 36 is such that flattening of the attachment flange during use typically does not plastically deform the fitting.

Figure 5:
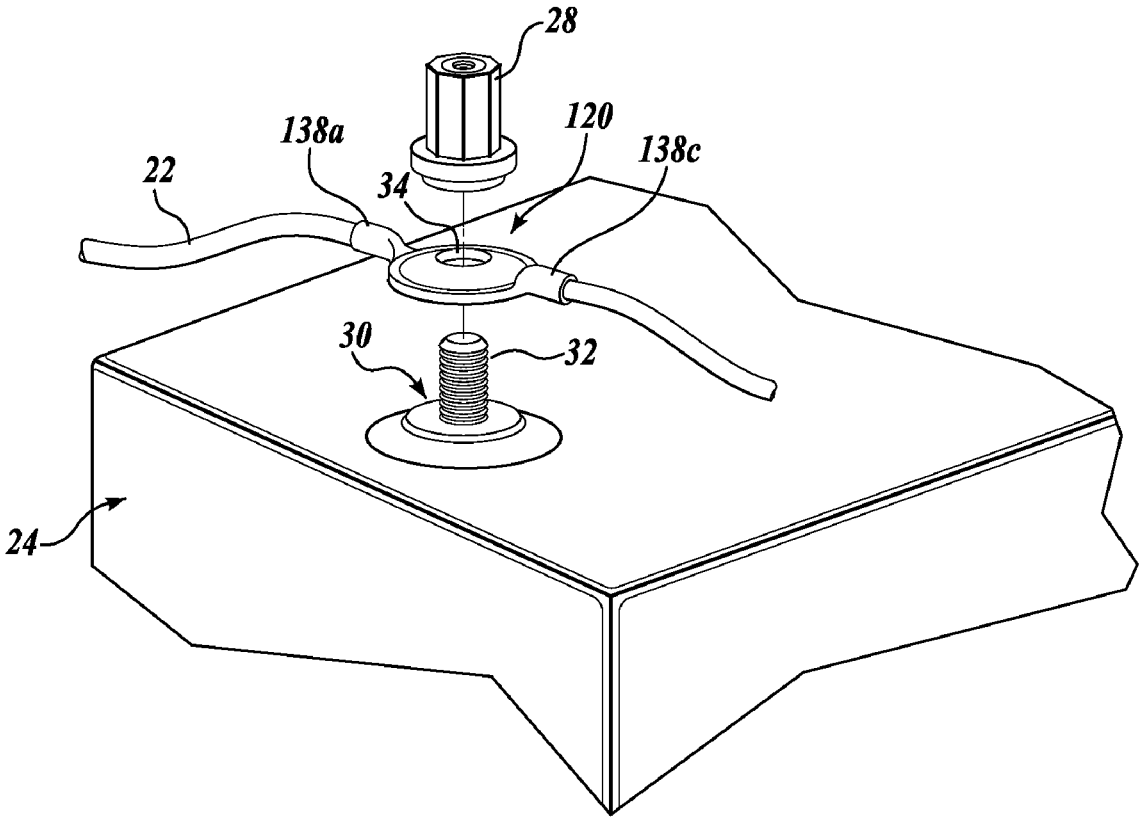
FIG. 5 is a partial isometric view of a battery cable terminal fitting constructed in accordance with another embodiment of the present disclosure, showing an exploded view of a connection between a battery and the battery cable terminal fitting.

A fitting 120 constructed in accordance with an alternate embodiment of the present disclosure may be best understood by referring to FIG. 5. The fitting 120 is substantially identical in materials and operation as the fitting 20 described with the following exceptions. The fitting 120 includes first and second conductor attachment portions 138*a* and 138*b*. Each of the first and second conductor attachment portions 138*a* and 138*b* allow for the connection of additional battery cable assemblies 26 to the terminal post 30 with a single fitting 120.

While illustrative embodiments have been illustrated and described, it will be appreciated that various changes can be made therein without departing from the spirit and scope of the appended claims. As a non-limiting example, as used in the above discussion, the usage of the phrase "substantially conical attachment flange" is intended to describe the approximate shape of a battery cable terminal fitting attachment flange that will result in substantially uniform contact between the battery cable terminal fitting and the battery terminal post when attached with an attachment nut or attachment bolt. It should be appreciated that deviations from a conical shape are possible without departing from the spirit and scope of the appended claims.

It should also be appreciated that the conical shape can be chosen to limit the strain levels experienced by the substantially conical attachment flange 36 to the elastic range of the material used so as to allow for re-use of the battery cable terminal fitting without re-forming. Additionally, while many materials can be used for battery cable terminal fittings in general, copper is a widely used material and can also be used with this invention.

The invention claimed is:

1. A battery cable terminal fitting for a battery having a terminal post, the battery cable terminal fitting comprising:

(a) an attachment flange having an interface area extending between the attachment flange and the terminal post when the battery cable terminal fitting is coupled to the battery, the interface area having a battery contact area that increases and is fully flattened against the terminal post as a nut used to fasten the attachment flange to the terminal post is tightened; and (b) a conductor attachment portion extending from the attachment flange.

2. The battery cable terminal fitting of claim 1, wherein the interface area is contoured to enhance electrical connection between the fitting and the battery when the fitting is coupled to the battery.

3. The battery cable terminal fitting of claim 2, wherein the interface area enhances electrical connection by increasing the battery contact area between the battery cable terminal fitting and the battery.

4. The battery cable terminal fitting of claim 2, wherein the attachment flange is substantially conical in cross-section.

5. The battery cable terminal fitting of claim 2, further comprising a second conductor attachment portion extending from the attachment flange.

6. The battery cable terminal fitting of claim 1, further comprising a second conductor attachment portion extending from the attachment flange.

7. A battery cable terminal fitting for a battery having a terminal post, the battery cable terminal fitting comprising:

(a) an attachment flange having an interface area extending between the attachment flange and the terminal post when the battery cable terminal fitting is coupled to the battery, the interface area having a contour that is fully flattened against the terminal post and, as a result, increases a battery contact area extending between the attachment flange and the terminal post as a nut used to fasten the attachment flange to the terminal post is tightened; and (b) a conductor attachment portion extending from the attachment flange.

8. The battery cable terminal fitting of claim 7, wherein the interface area enhances electrical connection by increasing the battery contact area between the fitting and the battery when the battery cable terminal fitting is attached to the terminal post.

9. The battery cable terminal fitting of claim 7, wherein the attachment flange is substantially conical in cross-section.

10. The battery cable terminal fitting of claim 9, further comprising a second conductor attachment portion extending from the attachment flange.

11. A battery cable terminal fitting for a battery having a terminal post with a threaded stud, the battery cable terminal fitting comprising:

(a) an attachment flange having a contour that is configured to be fully flattened against the terminal post when the battery cable terminal fitting is coupled to the battery, the attachment flange comprising:

(i) an attachment flange opening sized and configured to receive the threaded stud; and (ii) a battery contact area extending radially outwardly from the attachment flange opening between the attachment flange and the terminal post when the battery cable terminal fitting is coupled to the battery, the battery contact area increasing as a nut used to fasten the attachment flange to the terminal post is tightened; and (b) a conductor attachment portion extending from the attachment flange.

12. The battery terminal fitting of claim 11, wherein the contoured attachment flange is to enhance electrical connection between the fitting and the battery when the fitting is coupled to the battery.

13. The battery cable terminal fitting of claim 12, wherein the attachment flange is substantially conical in cross-section.

14. The battery cable terminal fitting of claim 11, further comprising a second conductor attachment portion extending from the attachment flange.

* * * * *